US007214292B2

(12) United States Patent
Bowdery et al.

(10) Patent No.: US 7,214,292 B2
(45) Date of Patent: May 8, 2007

(54) ADDITION OF THP OR THP+ SALT TO PULPING LIQUORS TO DESTROY CATALASE AND/OR CATALASE PRODUCING BACTERIA

(75) Inventors: Ruth Elizabeth Bowdery, Wolverhampton (GB); Stephanie Edmunds, Willenhall (GB); Robert Eric Talbot, Staffordshire (GB)

(73) Assignee: Rhodia Consumer Specialties Limited, Oldbury, West Midlands (GB)

( * ) Notice: Subject to any disclaimer, the term of this patent is extended or adjusted under 35 U.S.C. 154(b) by 46 days.

(21) Appl. No.: 10/181,104

(22) PCT Filed: Jan. 16, 2001

(86) PCT No.: PCT/GB01/00148

§ 371 (c)(1),
(2), (4) Date: Aug. 21, 2002

(87) PCT Pub. No.: WO01/53602

PCT Pub. Date: Jul. 26, 2001

(65) Prior Publication Data

US 2003/0089473 A1 May 15, 2003

(30) Foreign Application Priority Data

Jan. 22, 2000 (GB) ..... 0001417.5

(51) Int. Cl.
*D21C 3/00* (2006.01)

(52) U.S. Cl. ..... 162/78; 162/72; 162/76; 162/161

(58) Field of Classification Search ..... 162/72, 162/78, 76, 161
See application file for complete search history.

(56) References Cited

U.S. PATENT DOCUMENTS

| | | | | |
|---|---|---|---|---|
| 5,607,544 | A * | 3/1997 | Salzburger et al. | 162/5 |
| 5,728,263 | A | 3/1998 | Mattila et al. | |
| 5,885,412 | A * | 3/1999 | Paart et al. | 162/5 |
| 2002/0179262 | A1 * | 12/2002 | Ney et al. | 162/5 |
| 2004/0173328 | A1 * | 9/2004 | Hu et al. | 162/70 |
| 2004/0200588 | A1 * | 10/2004 | Walker | 162/72 |

FOREIGN PATENT DOCUMENTS

| | | | |
|---|---|---|---|
| EP | 0 385 801 | A | 9/1990 |
| EP | 562835 | A1 * | 9/1993 |
| GB | 938 990 | A | 10/1963 |
| GB | 2145708 | A * | 4/1985 |
| GB | 2182563 | A * | 5/1987 |
| GB | 2228679 | A * | 9/1990 |
| GB | 2 269 191 | * | 2/1994 |
| WO | WO 94 09360 | A | 4/1994 |
| WO | WO 96 14092 | A | 5/1996 |
| WO | 99/33345 | * | 7/1999 |
| WO | WO 9 33345 | A | 7/1999 |

* cited by examiner

*Primary Examiner*—Mark Halpern
(74) *Attorney, Agent, or Firm*—Frishauf, Holtz, Goodman & Chick, P.C.

(57) ABSTRACT

Pulping liquors used in the bleaching of pulps by hydrogen peroxide, and containing catalase-producing bacteria and/or catalase enzyme are treated with tris (hydroxymethyl) phosphine or a tetrakis (hydroxymethyl) phosphonium salt to kill the bacteria and destroy the enzyme.

12 Claims, No Drawings

ADDITION OF THP OR THP+ SALT TO PULPING LIQUORS TO DESTROY CATALASE AND/OR CATALASE PRODUCING BACTERIA

This application is a U.S. National Phase Application under 35 USC 371 of International Application PCT/GB01/00148 (published in English) filed Jan. 16, 2001.

This invention relates to bleaching of pulp by hydrogen peroxide and in particular to a method of treating pulping liquors by preventing or reducing the breakdown of peroxide by catalase.

Catalase is an enzyme that is produced by bacteria commonly found in pulp and paper mills. By consuming hydrogen peroxide, catalase can lower bleaching efficiency and decrease brightness levels of the finished paper.

It is known to kill catalase-producing bacteria by using a biocide such as glutaraldehyde.

The bactericidal efficacy of glutaraldehyde against catalase-producing bacteria present in pulp and water is known from U.S. Pat. No. 5,728,263. To be of use in pulp operations, a biocide must additionally be able to destroy the enzyme chemically.

It has now been found that tris (hydroxymethyl) phosphine and the tetrakis (hydroxymethyl) phosphonium salts (referred to collectively herein as THP) are more effective than glutaraldehyde at killing catalase-producing bacteria.

It has also been found that THP can be used more efficiently than glutaraldehyde to chemically destroy catalase as well as to kill the bacteria that produce it.

The present invention provides a method of treating pulping liquors for use in the bleaching of pulp by hydrogen peroxide, said liquors containing catalase and/or catalase-producing bacteria, with a biocide which reduces or destroys said catalase and/or said bacteria, characterised in that said biocide comprises tris (hydroxymethyl) phosphine (THP) or a tetrakis (hydroxymethyl) phosphonium salt (THP salt).

Preferably, the THP salt is tetrakis (hydroxymethyl) phosphonium sulphate (THPS).

Alternatively, the THP salt may be tetrakis (hydroxymethyl) phosphonium chloride, phosphate, bromide, carbonate, acetate, citrate, formate, lactate or borate.

The THP or THP salt is preferably added to the pulping liquor at a concentration of from 5 to 1000 ppm, desirably 10 to 200 ppm, more usually 15 to 100 ppm, especially 20 to 50 ppm. The pH may be from 4 to 12, usually 5 to 10, eg: 7 to 9 in an alkaline pulping system, or 5 to 7 in an acid pulping system.

The invention is illustrated by way of the following examples:

EXAMPLE 1

Experiments were carried out using a synthetic solution of catalase.

The catalase concentration used was ~3 ppm.

Solutions were all buffered at pH 8 (the anticipated pH of the stock chest).

Contact times of 5, 15 and 30 minutes were allowed.

Experiments were carried out at 20° C. and 45° C.

Nominal biocide concentrations of 100 ppm and 600 ppm (ai) were used.

Initial hydrogen peroxide concentration=0.5% w/w.

The experiments used a 75% wt on wt solution of tetrakis (hydroxymethyl) phosphonium sulphate, sold commercially under the Registered Trade Mark TOLCIDE PS75 and a 50% wt on wt solution of glutaraldehyde for comparison.

The principle of the experiments carried out was that when a solution containing active levels of the catalase enzyme is added to hydrogen peroxide, effervescence is observed as the reaction below is followed:

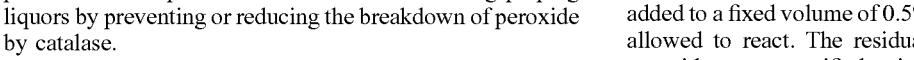

$$2H_2O_2+\text{Catalase}\rightarrow O_2+2H_2O$$

For the purpose of the experiments solutions of the catalase enzyme were contacted with either 100 to 600 ppm (ai) of TOLCIDE® PS75 or glutaraldehyde for 5, 15 and 30 minute contact times. The catalase/biocide solution was then added to a fixed volume of 0.5% w/w hydrogen peroxide and allowed to react. The residual concentration of hydrogen peroxide was quantified using a potassium permanganate titration and the % hydrogen peroxide remaining taken as a measure of the success of catalase destruction.

The results obtained are tabulated below in Table 1.

TABLE 1

| Concentration of Biocide/Temperature | Contact Time | % Hydrogen Peroxide Remaining | |
|---|---|---|---|
| ° C. | (minutes) | TOLCIDE ® PS75 | Glutaraldehyde |
| 600 ppm/45° C. | 5 | 37 | <1 |
| | 15 | 56 | 3 |
| | 30 | 100 | 100 |
| 100 ppm/45° C. | 5 | <1 | <1 |
| | 15 | 2 | <1 |
| | 30 | 76 | 37 |
| 600 ppm/20° C. | 5 | 22 | <1 |
| | 15 | 49 | 25 |
| | 30 | 75 | 60 |
| 100 ppm/20° C. | 5 | <1 | <1 |
| | 15 | 18 | 16 |
| | 30 | 39 | 25 |

In the absence of biocide treatment NO residual hydrogen peroxide was observed in the presence of catalase at a 3 ppm level.

The experiments indicate that TOLCIDE® PS75 is superior to glutaraldehyde for catalase destruction.

EXAMPLE 2

Samples of de-inked pulp and pulper fill water were received from two de-inking plants, samples 1 and 2. Control needs to be maintained over bacterial populations within these systems. Bacterial build-up in the re-cycled alkaline water, and contamination of the recycled fibre cause catalase levels to increase. The catalase breaks down peroxide in the helico pulper and stops the bleaching effect of the peroxide. It also means that maintenance of residual peroxide, which is required in the alkaline loop, is not possible.

Catalase is produced predominantly by general aerobic bacteria (GAB). During respiration, various toxic oxygen derivatives are produced within the bacterial cell, because of this, bacteria produce enzymes to destroy these toxic substances. The most common enzyme in this category is catalase, which breaks down hydrogen peroxide to oxygen and water.

As it is GAB which cause the problems of catalase build-up, quantitative suspension tests (QSTs) were carried out to compare the ability of THPS and glutaraldehyde to reduce the number of GAB present in the pulp/water samples provided.

An initial test was also carried out whereby mixed pulp/water samples, which had already been exposed to various concentrations of the test biocides, then had hydrogen peroxide added to them. The peroxide levels in these samples was monitored over one hour to gain an indication of the levels of catalase present by the rate of breakdown of hydrogen peroxide.

Before carrying out any efficacy tests, material from all of the pulp and water samples provided was plated out onto tryptone soya agar plates and incubated at 45° C., ie: plant operating temperature, for 1–2 days.

This was to ensure that the bacterial populations were similar both in appearance and, in the case of the water samples, in numbers.

All water samples were found to contain high levels of GAB ie: in the order of $10^7$ cfu/ml. (cfu=colony forming units).

It was assumed that the concentration of the pulp samples provided was approximately 15%, therefore a combined pulp/water sample was prepared by diluting sample 1 pulp with sample 2 water at a ratio of 1 in 15 (w/w), thus giving a pulp concentration of approximately 1%, which could be handled relatively easily within these tests. This diluted pulp sample was thoroughly mixed and dispersed in 9.0 g amounts into sterile universal bottles. These were then incubated at 45° C. for 1 hour.

Immediately prior to beginning the test, stock solutions of TOLCIDE® PS75 and glutaraldehyde were prepared at the following concentrations in sterile WHO standard hardness water:

500, 1000, 2000 and 3000 ppm product

At time zero, 1.0 ml of 10 times the final required biocide concentration was added to 9.0 g of the diluted pulp, so as to give the range:

50, 100, 200 and 300 ppm product for PS75 and glutaraldehyde

To one 9.0 g sample of diluted pulp, 1.0 ml of sterile WHO water alone was added to act as a control.

All samples were then incubated at 45° C.

Total viable counts (TVCs) of surviving GAB were made on each sample after contact times of 30 minutes, 1 hour and 3 hours. In order to do this, serial dilutions were prepared from the samples by initially adding 1.0 g of sample to 9.0 ml EST biocide inactivating medium, mixing and allowing to stand for at least 5 minutes. Further serial dilutions were then made by removing 1.0 ml and adding to 9.0 ml sterile Ringers solution. From each dilution, 0.1 ml was spread onto tryptone soya agar plates which were inverted and incubated at 45° C. for 2 days prior to enumeration of colonies.

The above procedure for QST was repeated using pulp and water from sample 2. In this second QST, two additional samples were included in which 200 ppm product of each biocide was tested. To prepare these samples, to 9.09 of chopped pulp, 1.0 ml of 10 volume $H_2O_2$ (equating to approximately 0.3% in the pulp) was added and mixed as thoroughly as possible. 2.0 g of this pulp was then added to 28 g of water sample 2 and thoroughly mixed. This pulp dilution was then used for the additional samples in order to assess the potential effect of $H_2O_2$ on the performance of the biocides.

The results are shown in the following tables 2 to 5:

Tables 2 and 3 record TVCs in colony forming units per ml (cfu/ml) and log reductions for QSTs on diluted pulp prepared from samples 1 and 2 respectively.

Tables 4 and 5 summarise log reductions achieved by both biocides in samples 1 and 2 respectively.

TABLE 2

QST Results comparing TOLCIDE ® PS75 to Glutaraldehyde in Sample 1

| | Conc | Contact Time (Hours) 0.5 | | 1.0 | | 3.0 | |
|---|---|---|---|---|---|---|---|
| Biocide | ppm product | TVC in cfu/ml | Log Reduction | TVC in cfu/ml | Log Reduction | TVC in cfu/ml | Log Reduction |
| Control | 0 | $4.6 \times 10^7$ | — | $6.7 \times 10^7$ | — | $8.0 \times 10^7$ | — |
| TOLCIDE ® PS75 | 50 | $1.69 \times 10^7$ | 0.43 | $1.11 \times 10^6$ | 1.78 | $1.5 \times 10^5$ | 2.72 |
| | 100 | $1.09 \times 10^5$ | 2.62 | $1.01 \times 10^4$ | 3.83 | $9.0 \times 10^2$ | 4.95 |
| | 200 | $2.8 \times 10^5$ | 2.21 | $1.7 \times 10^3$ | 4.60 | $8.0 \times 10^2$ | 5.00 |
| | 300 | $1.0 \times 10^4$ | 3.66 | $3.4 \times 10^3$ | 4.30 | $1.3 \times 10^3$ | 4.79 |
| Glutaraldehyde | 50 | $4.5 \times 10^7$ | 0.01 | $2.99 \times 10^7$ | 0.35 | $3.14 \times 10^6$ | 1.40 |
| | 100 | $1.09 \times 10^7$ | 0.62 | $1.81 \times 10^6$ | 1.57 | $1.4 \times 10^5$ | 2.75 |
| | 200 | $1.09 \times 10^6$ | 1.62 | $3.6 \times 10^5$ | 2.27 | $1.9 \times 10^4$ | 3.62 |
| | 300 | $1.03 \times 10^5$ | 2.65 | $4.1 \times 10^4$ | 3.22 | $1.0 \times 10^3$ | 4.90 |

TABLE 3

QST Results comparing TOLCIDE ® PS75 to Glutaraldehyde in Sample 2

| | Conc | Contact Time (Hours) 0.5 | | 1.0 | | 3.0 | |
|---|---|---|---|---|---|---|---|
| Biocide | ppm product | TVC in cfu/ml | Log Reduction | TVC in cfu/ml | Log Reduction | TVC in cfu/ml | Log Reduction |
| Control | 0 | $5.3 \times 10^7$ | — | $2.9 \times 10^7$ | — | $4.3 \times 10^7$ | — |
| TOLCIDE ® PS75 | 50 | $5.1 \times 10^6$ | 1.01 | $1.9 \times 10^6$ | 1.18 | $7.0 \times 10^5$ | 1.78 |
| | 100 | $4.6 \times 10^5$ | 2.06 | $2.0 \times 10^5$ | 2.16 | $4.3 \times 10^4$ | 3.00 |
| | 200 | $1.3 \times 10^5$ | 2.61 | $3.4 \times 10^4$ | 2.93 | $2.2 \times 10^4$ | 3.29 |

TABLE 3-continued

QST Results comparing TOLCIDE ® PS75 to Glutaraldehyde in Sample 2

| | | Contact Time (Hours) | | | | | |
|---|---|---|---|---|---|---|---|
| | Conc | 0.5 | | 1.0 | | 3.0 | |
| Biocide | ppm product | TVC in cfu/ml | Log Reduction | TVC in cfu/ml | Log Reduction | TVC in cfu/ml | Log Reduction |
| | 200P* | $1.0 \times 10^5$ | 2.72 | $1.6 \times 10^5$ | 2.26 | $6.1 \times 10^4$ | 2.84 |
| | 300 | $1.5 \times 10^5$ | 2.54 | $5.8 \times 10^4$ | 2.70 | $3.8 \times 10^4$ | 3.05 |
| Glutaraldehyde | 50 | $4.5 \times 10^7$ | 0.07 | $3.5 \times 10^7$ | 0 | $1.85 \times 10^7$ | 0.36 |
| | 100 | $9.1 \times 10^6$ | 0.76 | $6.7 \times 10^6$ | 0.63 | $4.1 \times 10^6$ | 1.02 |
| | 200 | $2.83 \times 10^6$ | 1.27 | $1.21 \times 10^6$ | 1.38 | $2.7 \times 10^6$ | 1.20 |
| | 200P* | $3.0 \times 10^6$ | 1.24 | $6.4 \times 10^5$ | 1.65 | $2.9 \times 10^5$ | 2.17 |
| | 300 | $1.9 \times 10^6$ | 1.44 | $1.15 \times 10^6$ | 1.40 | $8.1 \times 10^5$ | 1.72 |

*Approximately 0.3% $H_2O_2$ had been added to the pulp in these samples before it was diluted with water.

TABLE 4

Summary of Log Reductions from QSTs on Sample 1

| | | Contact Time (Hours) | | |
|---|---|---|---|---|
| Biocide | Conc ppm product | 0.5 Log Reduction | 1.0 Log Reduction | 3.0 Log Reduction |
| TOLCIDE ® PS75 | 50 | 0.43 | 1.78 | 2.72 |
| | 100 | 2.62 | 3.83 | 4.95 |
| | 200 | 2.21 | 4.60 | 5.00 |
| | 300 | 3.66 | 4.30 | 4.79 |
| Glutaraldehyde | 50 | 0.01 | 0.35 | 1.40 |
| | 100 | 0.62 | 1.57 | 2.75 |
| | 200 | 1.62 | 2.27 | 3.62 |
| | 300 | 2.65 | 3.22 | 4.90 |

TABLE 5

Summary of Log Reductions from QSTs on Sample 2

| | | Contact Time (Hours) | | |
|---|---|---|---|---|
| Biocide | Conc ppm product | 0.5 Log Reduction | 1.0 Log Reduction | 3.0 Log Reduction |
| TOLCIDE ® PS75 | 50 | 1.01 | 1.18 | 1.78 |
| | 100 | 2.06 | 2.16 | 3.00 |
| | 200 | 2.61 | 2.93 | 3.29 |
| | 200P* | 2.72 | 2.26 | 2.84 |
| | 300 | 2.54 | 2.70 | 3.05 |
| Glutaral-dehyde | 50 | 0.07 | 0 | 0.36 |
| | 100 | 0.76 | 0.63 | 1.02 |
| | 200 | 1.27 | 1.38 | 1.20 |
| | 200P* | 1.24 | 1.65 | 2.17 |
| | 300 | 1.44 | 1.40 | 1.72 |

*Approximately 0.3% $H_2O_2$ had been added to the pulp in these samples before it was diluted with water Results of these tests suggest that after a 1 hour 15 minute biocide contact time, THPS has reduced the population of catalase producing bacteria more effectively than glutaraldehyde. Results of both QSTs confirm this.

By looking at Tables 4 and 5, log reductions achieved by both biocides in each QST can be easily compared.

TOLCIDE® PS75 performs better against the indigenous GAB than does glutaraldehyde, particularly at the shorter contact times.

The invention claimed is:

1. A method of treating pulping liquors in a pulping system for use in the bleaching of pulp by hydrogen peroxide, said liquors containing catalase, said method consisting of adding to said liquors an effective amount of a compound to reduce or destroy said catalase, wherein said compound is selected from the group consisting of (i) tris (hydroxymethyl) phosphine (THP), and (ii) tetrakis (hydroxymethyl) phosphonium salts ($THP^+$ salts) and wherein said THP or $THP^+$ salt is added to said pulping liquor to give a concentration in the pulping liquor of from 5 ppm to 300 ppm.

2. The method of claim 1, wherein said $THP^+$ salt is tetrakis (hydroxymethyl) phosphonium sulphate.

3. The method of claim 1, wherein said the $THP^+$ salt is selected from the group consisting of tetrakis (hydroxymethyl) phosphonium chloride, tetrakis (hydroxymethyl) phosphonium phosphate, tetrakis (hydroxymethyl) phosphonium bromide, tetrakis (hydroxymethyl) phosphonium carbonate, tetrakis (hydroxymethyl) phosphonium acetate, tetrakis (hydroxymethyl) phosphonium citrate, tetrakis (hydroxymethyl) phosphonium formate, tetrakis (hydroxymethyl) phosphonium lactate and tetrakis (hydroxymethyl) phosphonium borate.

4. The method of claim 1, wherein said THP or THP+ salt is added to said pulping liquor to give a concentration from 10 ppm to 200 ppm.

5. The method of claim 4, wherein said concentration is from 15 ppm to 100 ppm.

6. The method of claim 4, wherein said concentration is from 20 ppm to 50 ppm.

7. The method of claim 1, wherein the pH of said pulping liquor is from 4 to 12.

8. The method of claim 7, wherein said pH is from 5 to 10.

9. The method of claim 7, wherein said pH is from 7 to 9 and said pulping system is an alkaline pulping system.

10. The method of claim 7, wherein said pH is from 5 to 7 and said pulping system is an acid pulping system.

11. A method of treating pulping liquors in a pulping system for use in the bleaching of pulp by hydrogen peroxide, said liquors containing catalase and catalase-producing bacteria, said method consisting of adding to said liquors an effective amount of a compound to reduce or destroy said catalase and said catalase-producing bacteria, wherein said compound is selected from the group consisting of (i) tris (hydroxymethyl) phosphine (THP), and (ii) tetrakis (hydroxymethyl) phosphonium salts ($THP^+$ salts) and wherein said THP or $THP^+$ salt is added to said pulping liquor to give a concentration in the pulping liquor of from 5 ppm of up to 300 ppm.

12. A method of treating pulping liquors in a pulping system for use in the bleaching of pulp by hydrogen peroxide, said liquors containing catalase-producing bacteria, said method consisting of adding to said liquors an effective amount of a compound to reduce or destroy said catalase-producing bacteria, wherein said compound is selected from the group consisting of (i) tris (hydroxymethyl) phosphine (THP), and (ii) tetrakis (hydroxymethyl) phosphonium salts ($THP^+$ salts) and wherein said THP or $THP^+$ salt is added to said pulping liquor to give a concentration in the pulping liquor of from 5 ppm to 300 ppm.

* * * * *